United States Patent [19]

Kojima

[11] 4,268,026

[45] May 19, 1981

[54] SHEET SUPPLY MEANS FOR A REPRODUCING APPARATUS

[75] Inventor: Kenji Kojima, Tokyo, Japan

[73] Assignee: Kabushiki Kaisha Ricoh, Tokyo, Japan

[21] Appl. No.: 60,421

[22] Filed: Jul. 25, 1979

[30] Foreign Application Priority Data

Aug. 2, 1978 [JP] Japan ..... 53-105538[U]

[51] Int. Cl.[3] ..... B65H 3/06; B65H 3/46

[52] U.S. Cl. ..... 271/121; 271/109; 271/171

[58] Field of Search ..... 271/109, 126, 127, 170, 271/171, 110–125, 37, 38, 34, 21, 22

[56] References Cited

U.S. PATENT DOCUMENTS 3,150,871 9/1964 Boblit et al. ..... 271/117 X 3,977,666 8/1976 Suzuki et al. ..... 271/171 X

OTHER PUBLICATIONS

Falcone, V. J., "Document Separator", *IBM Tech. Disc. Bulletin,* vol. 4, No. 4, Sep. 1961, p. 1.

*Primary Examiner*—Bruce H. Stoner, Jr.
*Attorney, Agent, or Firm*—Allison C. Collard; Thomas M. Galgano

[57] ABSTRACT

A sheet supply includes a sheet supply roller disposed for contact with copy sheets housed in a cassette for feeding forward one copy sheet at a time and a guide roller which is disposed on the outer side of the sheet supply roller. The guide roller is loosely mounted on the axis of the sheet supply roller so as to be movable in the direction of its diameter and such that it rotatably contacts the copy sheets under its dead weight.

1 Claim, 6 Drawing Figures

SHEET SUPPLY MEANS FOR A REPRODUCING APPARATUS

The invention relates to sheet supply means for use in a reproducing apparatus.

In cassette-type reproducing apparatus, there are provided a plurality of cassettes, housing copy sheets of various sizes, conforming to the size of originals to be copied or a variable multiplication ratio thereof. Among these cassettes, in the case of A4 and A5 size sheets, for example, problems may be overcome by merely changing the longitudinal dimension and conveying the sheet in a longitudinal or transverse direction. However, in the case of the longitudinal conveyance of A4 or B4 size sheets or transverse conveyance of A5 and B5 size sheets, the dimension of the cassettes with respect to their width is different with respect to each other. Consequently, the distance between the end portions of a sheet and the associated sheet supply roller becomes too large or too small to convey the sheet safely.

This point will be further described with reference to FIG. 2. A sheet supply roller 3 is usually rotated in the direction shown by the arrow and the topmost sheet forwarded thereby is caused to collide with a corner pawl 2 of the cassette 1 for producing a buckling in the topmost sheet (i.e., an upward bending) so that the sheets are fed out one at a time departing from the corner pawl 2. However, in the case of a narrow sheet width, the gap between the sheet supply roller 3 and the corner pawl 2 is so small that the buckling of the sheet ends becomes large and this generates breakdowns. If, on the other hand, the sheet width is too wide, the gap between the sheet supply roller 3 and the corner pawl 2 becomes large and the bending of the topmost sheet becomes insufficient. As a result, the separation of the topmost sheet from the other sheets in a stack of sheets is not effected and the proper functioning of the corner pawl 2 in preventing the conveyance of multiple sheets at a time is not effected efficiently.

Therefore, it has been previously proposed to employ a guide roller slightly smaller than the sheet supply roller and to mount the same on the axis of the sheet supply roller. However, a considerably high accuracy was demanded for providing a gap between a sheet and the guide roller. Furthermore, the sheet and the guide rollers were apt to forceably engage with each other owing to the tilting of the bottom plate or the like, causing skewing or the like. Moreover, if the diameter of a guide roller is larger than that of a sheet supply roller, the force applied to the topmost sheet by the guide roller becomes imbalanced owing to the tilting of the bottom plate or the like and this also invites skewing problems. If the guide roller was made as an elastic body, the friction between the elastic body and the sheet becomes greater and this induces the drawback of generating a difference of conveyance speed between a sheet supply roller and a guide roller.

It is an object of the present invention to overcome the above-mentioned drawbacks of the conventional sheet supply means.

It is also an object of the present invention to provide a supply means which is capable of consistently feeding out one sheet at a time from a supply of sheets which may be randomly sized, without jamming, and without tearing or otherwise damaging the sheet.

These objects are attained according to the invention by the provision of a sheet supply means comprising a sheet supply roller disposed for contact with copy sheets housed in a cassette for feeding out in a forward direction one copy sheet at a time and a guide roller which is situated at least to the outside of, and loosely mounted on the axis of, the sheet supply roller so as to be movable in the direction of its diameter and to rotatably contact with copy sheets under its dead weight.

For a better understanding of the invention as well as other objects and further features thereof, reference is had to the following detailed description of the present invention to be read in connection with the accompanying drawings, wherein.

Figure 3:
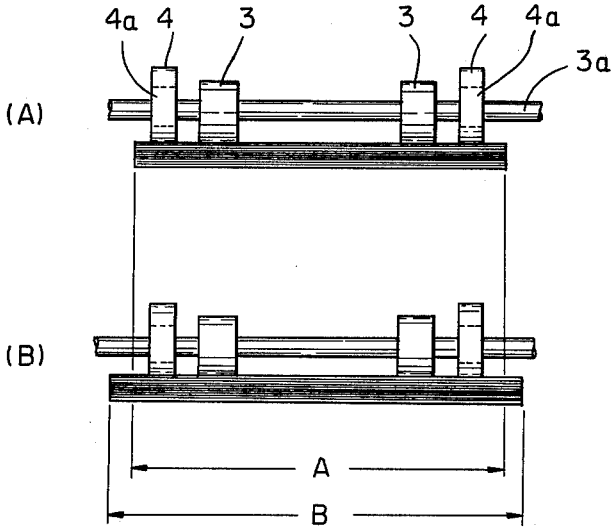
Figure 4:
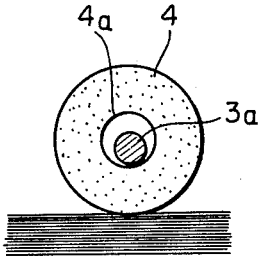
Figure 5:
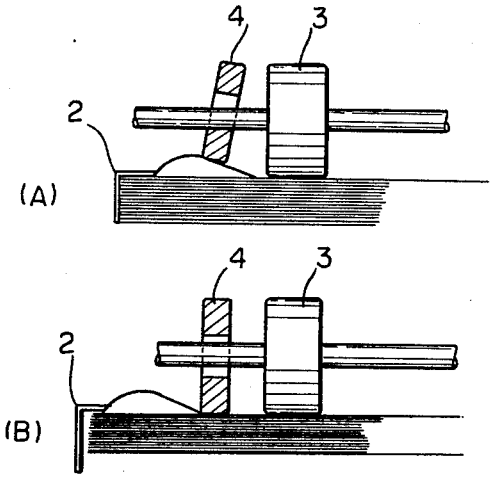
Figure 6:
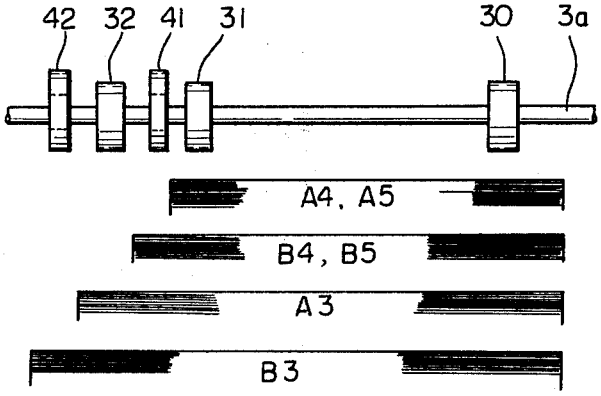

FIGS. 3(A) and (B) are fragmentarily-illustrated front views of one embodiment of the present invention;

FIG. 4 is a side view of the embodiment shown in FIG. 3;

FIGS. 5(A) and (B) are fragmentarily-illustrated front views showing different operational positions of the sheet supply means; and FIG. 6 is a front end view of another embodiment of the present invention.

Figure 1:
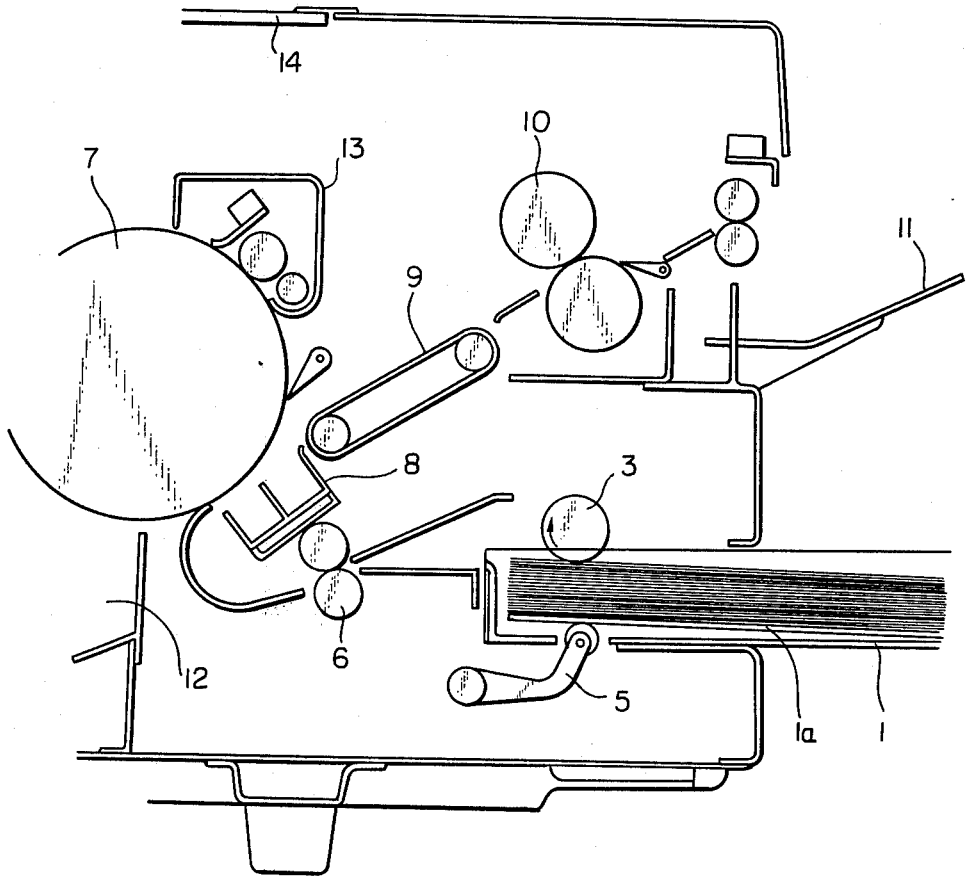
Fig. 1 PRIOR ART
FIG. 1 is a schematic sectional view of a conventional reproducing apparatus in which the sheet supply means of the present invention may be incorporated.
Figure 2:
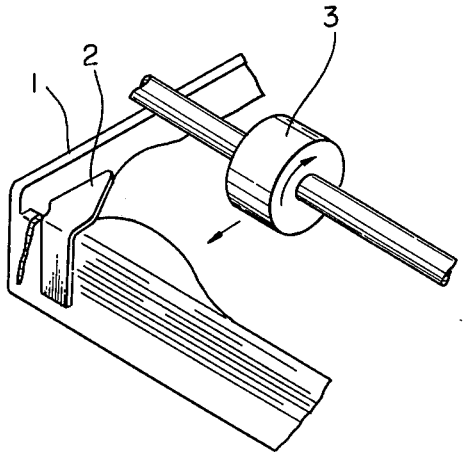
Fig. 2 PRIOR ART
FIG. 2 is a fragmentarily-illustrated perspective view showing the sheet supply in a conventional apparatus.

Referring now in detail to the drawings, an example of a conventional reproducing apparatus in which the sheet supply means of the present invention may be incorporated is shown in FIG. 1. The apparatus includes a cassette 1, a sheet supply roller 3, and a push up lever 5 for supplying a pressure to the sheet supply roller by pushing up the bottom plate 1a from under the cassette 1. A resist roller 6 is employed for feeding out a copy sheet in timed unison with the image position on a photosensitive plate 7. Transfer and neutralization changers 8 are also provided, as well as a carrier belt 9, a fixer 10, a tray 11 for the copy sheets, developing means 12, a cleaning device 13 and a platen 14. A corner pawl 2 is shown in FIG. 2.

FIG. 3 illustrates an embodiment of the sheet supply means in accordance with the present invention. In this embodiment, the sheet supply means is applied to a cassette of the type usable in a reproducing apparatus in which copy sheets are housed aligned with the center of a photosensitive plate 7 as a reference standard. To the outside of the right and left sheet supply rollers 3, there are provided guide rollers 4 made of an elastic material, such as rubber. At the center of guide rollers 4, there is provided an enlarged central aperture **4*a* for giving rollers 4 a large freedom of movement relative to the axis 3*a* of sheet supply roller 3** in a radial direction.

The operation of this embodiment will now be explained. In FIG. 3(A) and FIG. 5(A), copy sheets of a width A adapted to an arrangement of sheet supply rollers 3 are used. The leading side edge portions of a copy sheet pushed out forwardly by sheet supply roller 3 collide with corner pawl 2, whereby only the topmost sheet will be buckled upwardly. Guide roller 4 rides over this buckled portion owing to the freedom of movement given by the enlarged central aperture **4*a* and it assumes a position in which the operation of the sheet supply roller 3** in feeding out one copy sheet at a time is not obstructed and, simultaneously, prevents the excessive buckling of the sheet ends.

As seen in FIG. 3(B) and FIG. 5(B), when the width B of copy sheets is too large for the arrangement of sheet supply rollers 3, guide rollers 4 positioned outwardly of sheet supply rollers 3 hold down, by their dead weight, the end portions of the sheet protruding outwardly from sheet supply rollers 3. Therefore, when sheet supply rollers 3 push out the copy sheets, only the topmost sheet in the stack colliding with corner pawl 2 buckles at a point between the sheet ends and the guide rollers 4, whereby the topmost sheet is separated from the remaining sheets in the stack of sheets. Consequently, only the topmost sheet will be fed out forwardly.

FIG. 6 illustrates another embodiment of the present invention. In this embodiment, the sheet supply means is applied to a cassette of the type usable in reproducing apparatus in which copy sheets are housed with an end of the photosensitive plate 7 as a reference guide. At one end of the axis 3*a* of the sheet supply roller, there is provided a sheet supply roller 30. At the other end of axis 3*a* of the sheet supply roller, there are provided sheet supply rollers 31 and 32 at positions adapted to feed out copy sheets of the A4 or A3 size. In addition, between both sheet supply rollers 31 and 32, there is provided a guide roller 41 in a position adapted to feed out copy sheets of the B4 size. To the outside of sheet supply roller 32, a guide roller 42 is provided in a position adapted for feeding out copy sheets of the B3 size and which is radially movable in the direction of the diameter of axis 3*a* as mentioned above. Thereby, a broad range of copy sheets from B3 size to A5 size may be safely fed out forwardly, only one sheet at a time.

Furthermore, it is not always necessary that guide roller 4 be an idler roller mounted for free rotation on axis 3*a* of sheet supply roller 3. Guide roller 4 may be rotatable along with sheet supply rollers 3.

According to the present invention, as mentioned above, a guide roller is provided at least at one side of the sheet supply rollers and this guide roller is loosely fitted to the axis of the sheet supply roller so as to effect rolling contact thereof with the copy sheet by its dead weight. Hence, even in the case of copy sheets having a width larger than the size to be safely fed out by these sheet supply rollers, the guide roller holds down, by its dead weight, the ends of the copy sheet extending outwardly beyond the sheet supply rollers and assists the buckling of the topmost sheet by the corner pawl of the cassette, thereby enabling the supplying of one sheet at a time safely. Furthermore, since the guide roller is mounted so as to be movable in the direction of the diameter of the the axis of the sheet supply roller, when the size of the copy sheets is large enough to be fed out by the sheet supply rollers, the guide roller will ride upwardly on the upwardly buckled end portions of the copy sheet so as to insure the safe feeding of one copy at a time and to prevent tearing or damaging of the sheet. In addition, this supply means affords a simple construction only essentially requiring that a guide roller be merely loosely mounted outwardly of the sheet supply rollers. The supply means is trouble-free and may be manufactured cheaply.

While we have described and illustrated herein a preferred form of our invention, it will be apparent to those skilled in the art that changes and modifications may be made thereto without departing from the spirit and intention of our invention which is to be limited only to the scope of the appended claim.

What is claimed is:

1. In a sheet supply device for a cassette-type reproducing apparatus having at least one cassette for housing a stack of copy sheets, the combination comprising:

at least one rotatable sheet supply roller mounted on a shaft and disposed for contact with the copy sheets housed in said cassette for feeding said sheets in a forward manner one sheet at a time;

at least one corner pawl mounted on said cassette and disposed to engage an edge portion of a copy sheet so as to cause, in cooperation with said sheet supply roller, an upward buckling of a top sheet of said stack at a point between said sheet supply roller and said pawl; and at least one guide roller mounted on said shaft between said sheet supply roller and said pawl, said guide roller having a central aperture which has a larger diameter than said shaft so that said guide roller is loosely mounted on said shaft so as to be movable in a generally radial direction relative to the axis of said shaft and so as to rotatably contact the copy sheets under its dead weight.

* * * * *